US008281522B1

(12) United States Patent
Hawryshko et al.

(10) Patent No.: US 8,281,522 B1
(45) Date of Patent: Oct. 9, 2012

(54) VENTILATED ROOFING SYSTEM

(76) Inventors: Andrei Hawryshko, Etobicoke (CA); Andriy Havryshko, Etobicoke (CA)

( * ) Notice: Subject to any disclaimer, the term of this patent is extended or adjusted under 35 U.S.C. 154(b) by 30 days.

(21) Appl. No.: 12/887,255

(22) Filed: Sep. 21, 2010

(51) Int. Cl.
*E04B 7/00* (2006.01)
*E04D 3/40* (2006.01)
*E04D 13/00* (2006.01)

(52) U.S. Cl. ..... 52/95; 52/198; 454/260

(58) Field of Classification Search ..... 52/95, 96, 52/302.1, 302.3, 198, 199; 454/260, 365
See application file for complete search history.

(56) References Cited

U.S. PATENT DOCUMENTS

| | | | | | |
|---|---|---|---|---|---|
| 3,387,420 | A | * | 6/1968 | Long | 52/302.3 |
| 3,797,180 | A | | 3/1974 | Grange | |
| 4,371,031 | A | * | 2/1983 | Bernander et al. | 165/54 |
| 4,507,901 | A | * | 4/1985 | Carroll | 52/302.3 |
| 4,850,166 | A | * | 7/1989 | Taylor | 52/199 |
| 4,937,990 | A | * | 7/1990 | Paquette | 52/199 |
| 5,022,314 | A | | 6/1991 | Waggoner | |
| 5,361,551 | A | | 11/1994 | Post | |
| 5,473,847 | A | * | 12/1995 | Crookston | 52/302.1 |
| 5,487,247 | A | * | 1/1996 | Pigg | 52/302.3 |
| 5,941,028 | A | | 8/1999 | Hicks | |
| 6,213,868 | B1 | | 4/2001 | Sells | |
| 6,298,613 | B1 | * | 10/2001 | Coulton et al. | 52/199 |
| 6,598,356 | B1 | | 7/2003 | Sells | |
| 6,780,099 | B1 | | 8/2004 | Harper | |
| 7,143,557 | B1 | * | 12/2006 | Ayers, Jr. | 52/302.1 |
| 7,302,776 | B2 | * | 12/2007 | Duncan et al. | 52/95 |
| 2011/0030287 | A1 | * | 2/2011 | Moore | 52/95 |

* cited by examiner

*Primary Examiner* — Brian Glessner
*Assistant Examiner* — Paola Agudelo
(74) *Attorney, Agent, or Firm* — Montgomery Patent & Design, LLC; Robert C. Montgomery; Joseph Yaksich

(57) ABSTRACT

A multi-layered roofing system and method of construction which replaces standard sloped or flat roof surfaces is herein disclosed. The system comprises a roof surface having a dual layer construction provided by two (2) layers of roof sheathing material which are separated by vented spacing members. A top layer of sheathing material is covered with a top layer of roofing felt, shingles, rolled roofing, or the like. The system utilizes various vented spacing channels, vented drip edge elements, and a vented ridge vent that provide for a ventilating gap within the roof. The ventilating gap runs the entire length of the roof and helps to moderate interior building temperatures, thereby improving energy efficiency.

18 Claims, 4 Drawing Sheets

VENTILATED ROOFING SYSTEM

RELATED APPLICATIONS

The present invention was first described in a notarized Official Record of Invention on May 26, 2009, that is on file at the offices of Montgomery Patent and Design, LLC, the entire disclosures of which are incorporated herein by reference.

FIELD OF THE INVENTION

The present invention relates generally to roof ventilation systems, and more particularly, to a ventilated roofing system and method of construction assembled upon a roof structure which enables a flow of air between parallel roofing layers.

BACKGROUND OF THE INVENTION

Improper building techniques are often the underlying culprit behind high energy costs, structural damage, and even health problems for the building inhabitants. Many of these problems are the direct result of improper ventilation. In the hot summer, direct sunlight overheats the roof, and creates a furnace effect in the attic. The air in the house, especially on the second floor if present, becomes unbearable. Excessive energy consumption from fans and air conditioning drives up electric bills. In the winter, condensation of humid air in the attic can lead to rotting of structural wood, deterioration of insulation, and result in mold and mildew leading to health problems. Finally, a lack of proper roof ventilation results in rapid aging of the roofing shingles, which may lead to leaks and home damage.

Various attempts have been made to address these problems. These attempts can be seen by example in several U.S. Patents. U.S. Pat. No. 3,797,180, issued in the name of Grange, discloses a ventilated roof construction having a continuous corrugated baffle positioned between parallel roofing members. The baffle is provided to allow air flow from the fascia to the ridge to prevent the formation of ice dams.

U.S. Pat. No. 4,937,990, issued in the name of Paquette, discloses a ventilation system for roofs comprising an impermeable sheet having a series of openings on its surface and a series of roofing supports to provide a means to dry roofing insulation when there is a break in the vapor barrier protecting the insulation.

U.S. Pat. No. 6,780,099, issued in the name of Harper, discloses a roof ventilation system comprising plurality of roof panels having an internal triangular shaped baffling for facilitating the flow of air from lower edge portions of the roof structure to the upper ridge portion.

Other solutions include ridge cap ventilators and roof construction, as can be seen by example in U.S. Pat. No. 5,022,314, issued in the name of Waggoner, which describes a roof ventilation apparatus and ventilation spacers for placement between fascia and roof sheathing, as can be seen by example in U.S. Pat. No. 5,361,551, which describes a ventilation spacer for roof construction.

While these devices may accomplish their specific intended purpose, each suffers from one (1) or more disadvantage or deficiency with respect to design, function, or effectiveness. Accordingly, there is a need for a means by which roofing can be provided with complete and thorough ventilation in an effort to combat the above-mentioned problems. The development of the present invention substantially departs from the conventional solutions and in doing so fulfills this need.

SUMMARY OF THE INVENTION

In view of the current lack and inherent problems in the art, the inventor has recognized the need for a novel roof ventilation system which provides roofs with improved ventilation properties and thus, the object of the present invention is to solve the aforementioned disadvantages and provide for this need.

Another object of the present invention is to provide a system which allows a free and multidirectional flow of air from lower regions of a roof structure to upper regions of the roof structure without restrictions.

Another object of the present invention is to provide a system which provides more comfortable living spaces.

Yet another object of the present invention is to provide a system which increases the insulation factor of roof structures.

Yet another object of the present invention is to provide a system which can be used on sloped or flat roofs, having a low profile design which is structurally sound.

Yet another object of the present invention is to provide a system which is passive and requires no power or moving parts to facilitate the flow of air.

Yet another object of the present invention is to provide a system which is simple and intuitive to construct and install with little to no additional training.

Yet another object of the present invention is to provide a system which is durable and economical to manufacture.

One (1) or more of these and other objects of the invention are achieved by a providing a ventilated roofing system for use with a roof structure having a first sheathing layer affixed atop a roof structure and extending from a ridge portion to an eave portion, a second sheathing layer disposed above the first sheathing layer in a parallel orientation and also extending from the ridge portion to the eave portion, a ridge sheathing layer comprising a plurality of an inverted V-shaped panels disposed above the second sheathing layer in a parallel orientation and extending a length of the ridge portion of the roof structure, a first plurality of vented channels affixed between a top surface of the first sheathing layer and a bottom surface of the second sheathing layer to form a first gap, a second plurality of vented channels affixed between a top surface of the second sheathing layer and a bottom surface of the ridge sheathing to form a second gap, and a plurality of vented drip edges capable of attachment to lower edge portions of the second sheathing layer or the ridge sheathing layer to cover the first and second gap. The system provides a flow of air between the eave portion and the ridge portion of the roof structure.

The first plurality of vented channels and the second plurality of vented channels each comprise a planar top panel, a pair of angled side panels which extend downwardly from the top panel and having a plurality of rectangular vent openings, and a horizontal fastening flange extending longitudinally along a bottom edge portion of each of the pair of side panels capable of attachment to the top surface of the first sheathing layer or a top surface of the second sheathing layer.

The plurality of vented drip edges each comprise a substantially planar top portion capable of laying flat against a top surface of a lower edge portion of the second sheathing layer or a top surface of a lower edge portion of the ridge sheathing layer, a substantially planar wall portion extending downwardly from the top portion having a plurality of louvered ventilation slots, and an outwardly deflected drip edge longitudinally extending along a bottom edge portion of the wall portion.

Yet another embodiment provides an independent extraction and storage clip comprising a solid base having a centrally disposed slot, in which the extraction and storage clip is sliding attached along a longitudinal axis of a separate flexible tube container. The slot being in contact with and flattening an exterior of the tube container for evacuating a quantity of viscous fluid from within the tube container.

Furthermore, the described features and advantages of the invention may be combined in various manners and embodiments as one skilled in the relevant art will recognize. The invention can be practiced without one (1) or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
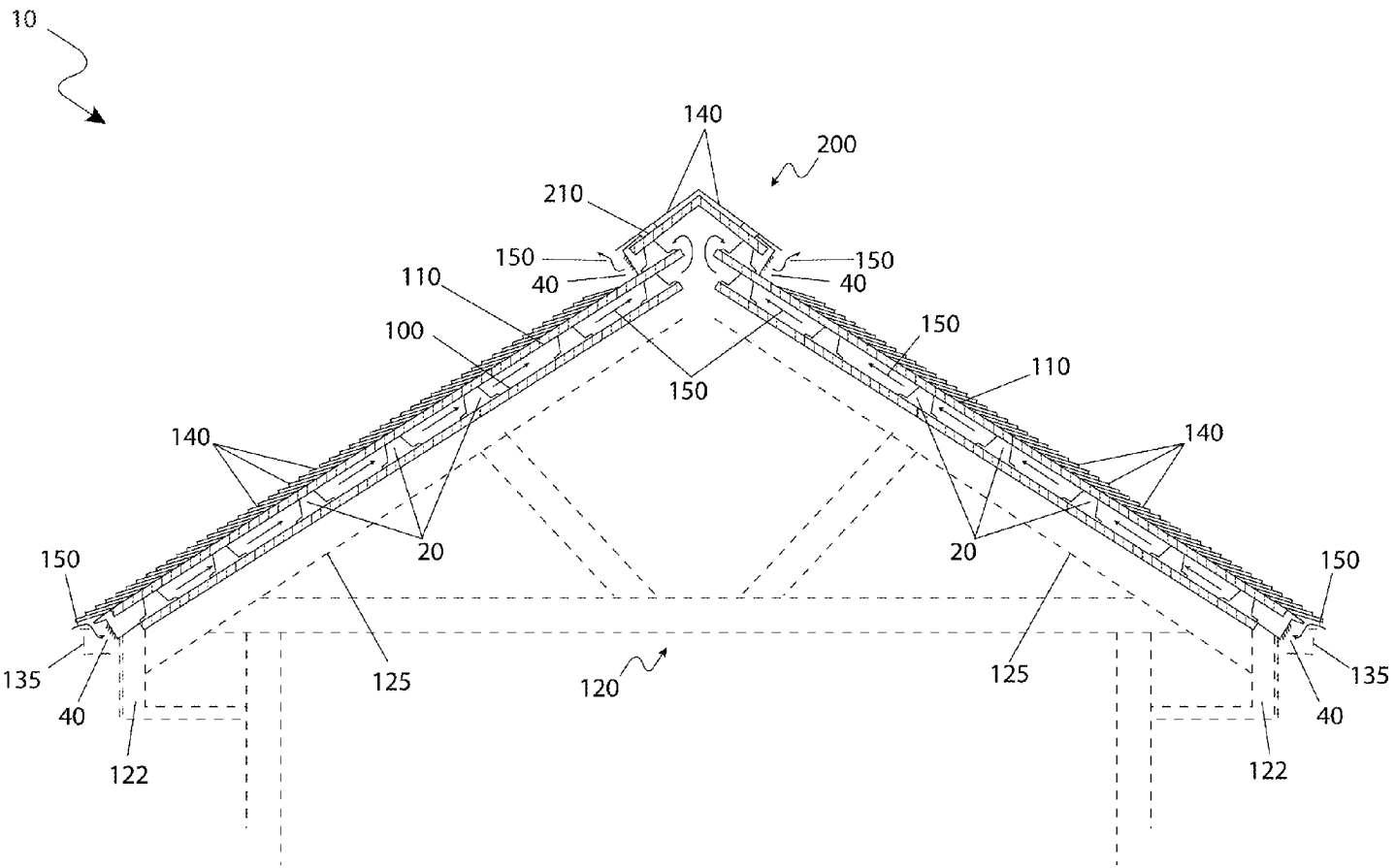
FIG. 1 is a section view of the ventilated roofing system 10, according to a preferred embodiment of the present invention.

| | |
|---|---|
| 10 | ventilated roofing system |
| 20 | vented channel |
| 22 | side panel |
| 24 | top panel |
| 26 | flange |
| 28 | vent opening |
| 30 | fastener aperture |
| 40 | vented drip edge |
| 42 | upper structure |
| 44 | drip edge |
| 46 | louver |
| 100 | first sheathing layer |
| 110 | second sheathing layer |
| 115 | fastener |
| 120 | roof structure |
| 122 | fascia board |
| 125 | roof rafter |
| 130 | truss |
| 135 | gutter |
| 140 | top covering roofing materials |
| 150 | air flow |
| 200 | ridge vent assembly |
| 210 | ridge sheathing |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a ventilated roofing system (herein described as the "system") 10 and a method of installation and construction thereof, which provides a means for constructing a roof assembly resulting in improved energy efficiency and operational characteristics. The system 10 is envisioned to be provided as new construction or as a replacement of standard flat or sloped shingled roof surfaces. The system 10 comprises a dual-layer sheathing construction further comprising a lower first sheathing layer 100 and an upper second sheathing layer of roof sheathing material, such as plywood, being separated by a matrix of vented channels 20. The second sheathing layer 110 is covered with conventional top covering roofing materials 140 such as roofing felt, shingles, rolled roof membrane, or the like. The system 10 also comprises a vented drip edge 40 to cover side openings formed between sheathing layers and being adjacent to a fascia board area 120. The vented channels 20 and vented drip edge 40 are utilized to form a ridge vent assembly 200 along a ridge portion of a roof structure 120, thereby establishing a continuous path of air flow 150 in all directions between eave and ridge portions of the roof structure 120.

Figure 2:
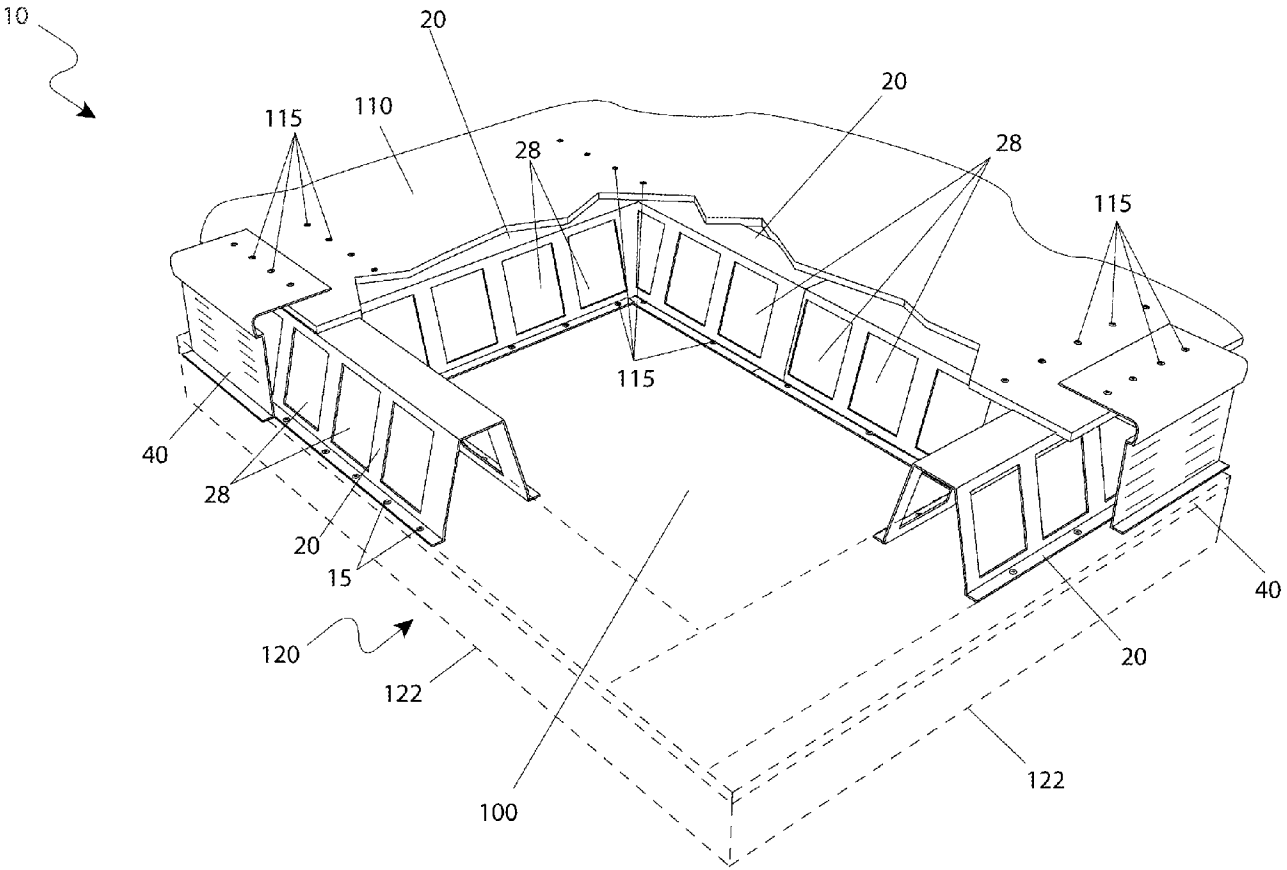
FIG. 2 is a cut-away perspective view of an ventilated roofing system 10, according to a preferred embodiment of the present invention.

Referring now to FIGS. 1 and 2, a section and a cut-away view of the system 10, respectively, according to the preferred embodiment of the present invention, are disclosed. The system 10 comprises a bottom layer of first sheathing 100, a plurality of vented channel lengths 20, an upper layer of second sheathing 110, a plurality of vented drip edge sections 40, and a layer of top covering roofing materials 140. The first sheathing layer 100 is fastened to a building roof substructure 120, the roof substructure 120 typically comprising fascia boards 122, rafters 125, trusses 130, gutters 135, and the like, in a conventional manner using common roofing fasteners 115 such as nails, screws, or the like. A matrix of vented channels 20 are fastened to a top surface of the first sheathing layer 100 using common roofing fasteners 115 being arranged in a rectangular matrix pattern at right angles. The second sheathing layer 110 is subsequently affixed to top surfaces of the vented channel sections 20 and fastened to using roofing fasteners 115. The second sheathing layer 110 is applied in a parallel orientation with respect to the subjacent first sheathing layer 100 and separated by the vented channels 20, thus forming a gap of approximately two (2) inches to establish and provide for the air flow 150. The vented channels 20 each comprise integral rectangular vent openings 28 therethrough, thus allowing the flow of air 150 to move freely between the sheathing layers 100, 110 (see FIG. 3). The first 100 and second 110 sheathing layers comprise common roof decking materials such as one-half (½), five-eighths (⅝), or three-quarter (¾) inch thick plywood or equivalent materials.

The system 10 also comprises a ridge vent assembly 200 to allow the air flow 150 to also pass freely through a ridge portion of the roof structure 120. The ridge vent assembly 200 comprises a pair of vented channels 20 being arranged in a parallel manner along a roof peak and fastened to a top surface of the second sheathing layer 110 along a partial length of or an entire length of the roof peak. The vented channels 20 are subsequently covered using ridge sheathing 210 approximately six (6) to twelve (12) inches wide; forming an inverted "V" shape in a conventional manner. The ridge sheathing 210 is covered with top covering roofing materials 140 such as felt paper, shingles, rolled roofing, and the like. The ridge sheathing 210 preferably comprises similar sheathing materials as the aforementioned first 100 and second 110 sheathing layers.

The vented drip edge 40 provides aesthetic and weather-resistant functions in a similar manner as common drip edge products common in the industry; however, each length of vented drip edge 40 comprises a plurality of louvers 46 along an integral vertical surface positioned perpendicularly to the flow of air 150, thereby providing the air flow 150 a means through the system 10. The vented drip edge 40 is affixed to top surfaces of the second 110 and ridge 210 sheathing portions in a conventional manner using roofing fasteners 115 (see FIGS. 2 and 4).

The system 10 enables the air flow 150 to travel in any direction between the sheathing layers 100, 110, 210; however, during warm or sunny conditions, it is envisioned that the flow of air 150 will typically enter the system 10 through the vented drip edge portion 40 along a lower edge and move upwardly through the vented channels 20 and exit through the vented ridge vent assembly 200, thereby effectively cooling the roof system 10 and consequently the entire building structure 120.

Figure 3:
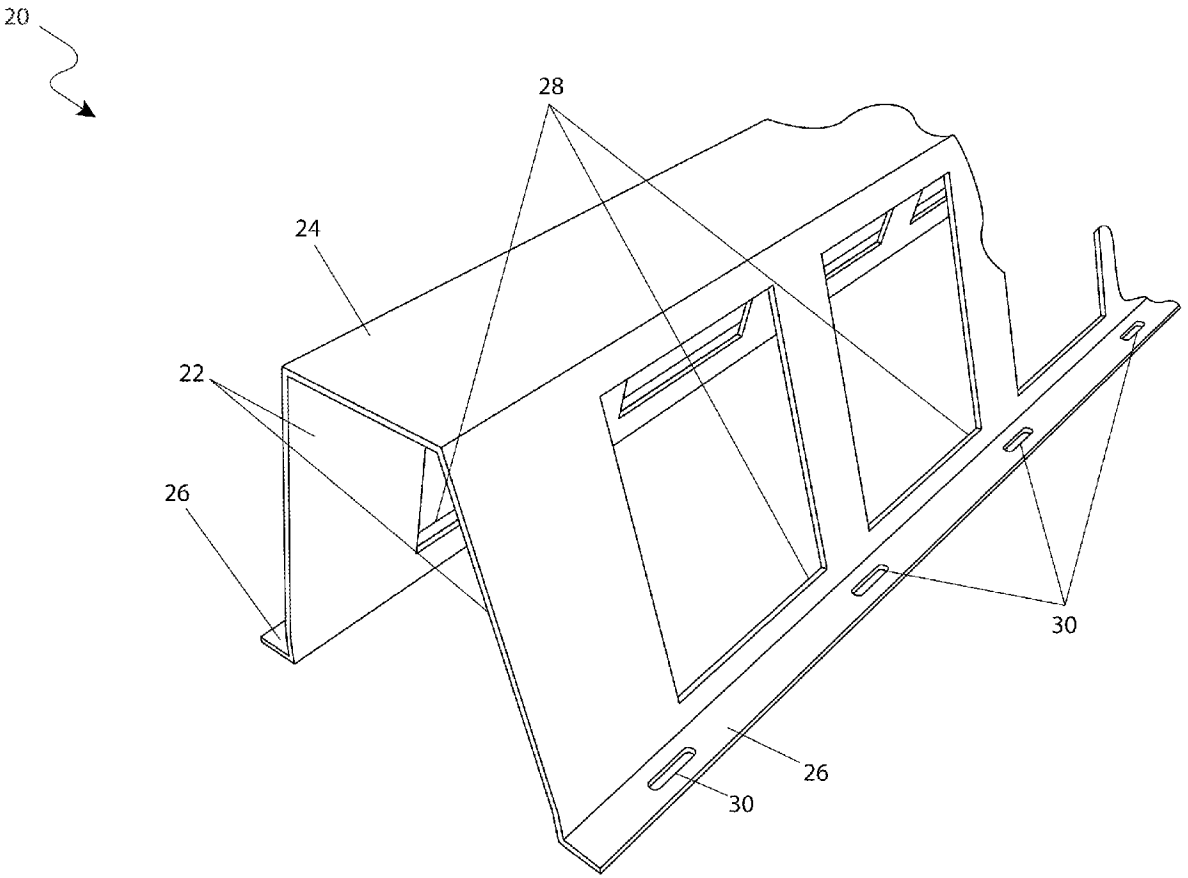
FIG. 3 is a close-up perspective view of a vented channel portion 20 of the ventilated roofing system 10, according to a preferred embodiment of the present invention; and, FIG. 4 is a close-up perspective view of a vented drip edge portion 40 of the ventilated roofing system 10, according to a preferred embodiment of the present invention.

Referring now to FIG. 3, a close-up perspective view of the vented channel portion 20 of the system 10, according to a preferred embodiment of the present invention, is disclosed. Each vented channel 20 comprises a pair of side panels 22, a top panel 24, a pair of fastening flanges 26, and a plurality of vent openings 28. The vented channel 20 is envisioned being made of extruded or formed plated sheet metal having approximately sixteen (16) or eighteen (18) gauge thickness and being capable of supporting anticipated typical loading from snow, ice, and the like, upon the building structure 120. The vented channel 20 comprises a cross-sectional shape of an inverted "U" having slightly diverging side panel portions 22 so as to form a symmetrical trapezoidal structure, thereby providing a strong structure capable of withstanding both compressive loads and side loading conditions. The vented channel 20 further comprises horizontally extending fastening flanges 26 integrally formed along bottom edges of the side panel portions 22. The flanges 26 further compromise a plurality of equally-spaced fastener apertures 30 for attachment to the sheathing 110, 210 using the fasteners 115. The vented channel 20 is envisioned being introduced in various standard lengths such as six (6), eight (8), and ten (10) feet long which may be cut to length, so as to fit a particular application. The vent opening portions 28 of the vented channel 20 comprise equally-spaced rectangular openings along both side panels 22, thereby enabling ample movement of the air flow 150 therethrough and establishing a continuous flow of air 150 between the bottom edge fascia 122 and the ridge vent assembly 200 portion of the system 10 (see FIG. 1).

Figure 4:
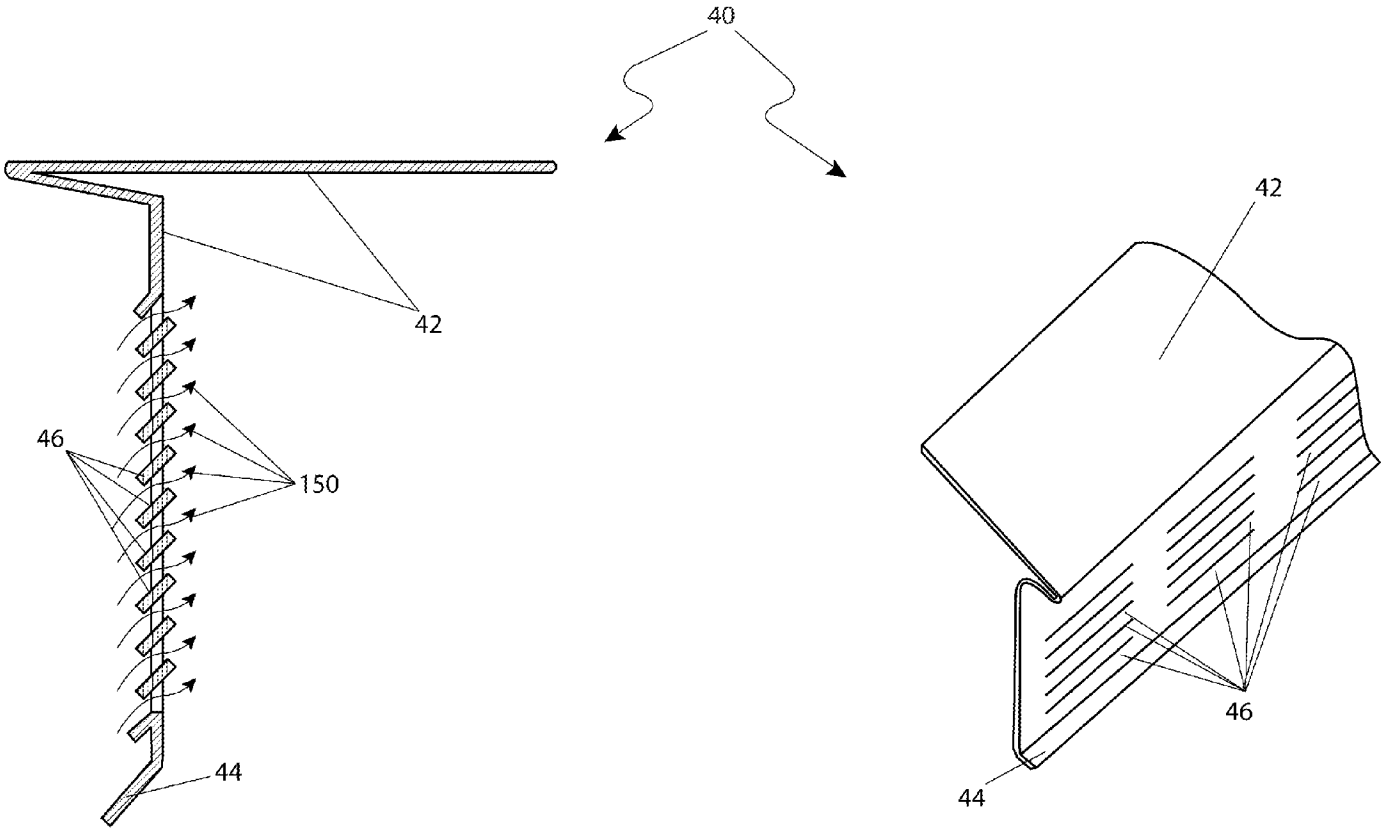

Referring now to FIG. 4, a section view and a close-up perspective view of the vented drip edge portion 40 of the system 10, according to a preferred embodiment of the present invention, are disclosed. The vented drip edge 40 further comprises an extruded or formed metal or plastic shape having a generally "T"-shaped upper structure 42, an outwardly angled lower drip edge portion 44 and a plurality of parallel louvers 46 penetrating a vertical side surface. The vented drip edge 40 comprises a similar shape and function as conventional drip edge products common in the industry; however, the vented drip edge 40 comprises the louvered outwardly facing surface 46 which allows the flow of air 150 through the vented drip edge 40 to cool the roof system 10 and subjacent building structure 120 (see FIG. 1). The louvers 46 comprise linear outwardly angled penetrations approximately one-eighth (⅛) to one-quarter (¼) of an inch apart and arranged in a parallel horizontal orientation. A top horizontal surface of the upper structure portion 42 of the vented drip edge 40 is utilized to fasten the vented drip edge 40 to the first sheathing layer 110 and the ridge sheathing 210 using fasteners 115 in an expected manner. The vertical portion of the upper structure 42 is positioned to cover the gap formed between the first 100 and second 110 sheathing layers and also the second 110 and ridge 210 sheathing layers. The vented drip edge 40 extends downward from the second sheathing layer and is secured to a top edge region of the fascia board area 122 or extends downward from the ridge sheathing 210 and is secured to the second sheathing layer 110; depending upon the location and application (see FIG. 2). The vented drip edge 40 is envisioned being introduced in various standard lengths such as six (6), eight (8), and ten (10) feet long and may be cut to a desired length.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIGS. 1 and 2.

A method of installing the system 10 may be achieved by performing the following steps: installing a first sheathing layer 100 upon a roof structure of rafters 125 and trusses 130 in a conventional manner; arranging a plurality of lengths of vented channels 20 at right angles and at appropriate spacing therebetween, based upon anticipated roof loading specifications; securing the vented channels 20 to the first sheathing layer 20 using common fasteners 115; fastening the second sheathing layer 110 to top surfaces of the vented channels 20 using common fasteners 115; constructing the ridge vent assembly 200 by installing a pair of vented channels 20 in a parallel arrangement along an open ridge area as previously described; fastening the ridge sheathing 210 to the vented channels 20 to form an inverted "V"-shaped structure 200 using the fasteners 115; affixing lengths of the vented drip edge 40 along all lower and side fascia board areas 122 of the first 100 and second 110 sheathing layers, and along side portions of the ridge vent assembly 200, using common fasteners 115; installing conventional top covering roofing materials 140 upon the second 110 and ridge 210 sheathing layers using felt paper, shingles, rolled roofing, or the like; and, benefiting from increasing a thermal efficiency of a building structure 120 resulting from an improved air flow 150 passing through the present roofing system invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A ventilated roofing system for use with a roof structure, said system comprising:

a first sheathing layer attached to exterior sides of said roof structure extending from a ridge portion to an eave portion;

a second sheathing layer disposed above said first sheathing layer in a parallel orientation extending from said ridge portion to said eave portion;

a ridge sheathing layer disposed above said second sheathing layer in a parallel orientation and extending a length of said ridge portion of said roof structure;

a plurality of vented channels each comprising:

a planar top panel;

a pair of angled side panels extending downwardly from said top panel, each of said side panels having a plurality vent openings; and, a horizontal fastening flange extending longitudinally along a bottom edge portion of each of said pair of side panels; and, a plurality of vented drip edges for facilitating proper water drainage;

wherein a first plurality of vented channels is affixed between a top surface of said first sheathing layer and a bottom surface of said second sheathing layer forming a first gap;

wherein a second plurality of vented channels is affixed between a top surface of said second sheathing layer and a bottom surface of said ridge sheathing forming a second gap;

wherein a first plurality of vented drip edges are affixed between said first sheathing layer and said second sheathing layer;

wherein a second plurality of vented drip edges are affixed between said ridge sheathing layer and said second sheathing layer; and, wherein said system provides a flow of air between said eave portion and said ridge portion of said roof structure.

2. The system of claim 1, wherein each of said plurality of vented drip edges further comprises:

a substantially planar top portion for laying flat against a top surface of a lower edge portion of any sheathing layer;

a substantially planar wall portion extending downwardly from said top portion, said wall portion having a plurality of louvered ventilation slots; and, an outwardly deflected drip edge longitudinally extending along a bottom edge portion of said wall portion.

3. The system of claim 2, wherein said plurality of vent openings being equally spaced longitudinally along said pair of side panels.

4. The system of claim 3, wherein said first plurality of vented channels being arranged in a matrix configuration comprising a plurality of right angles.

5. The system of claim 4, wherein said second plurality of vented channels being parallel to said ridge of said roof structure.

6. The system of claim 5, wherein said fastening flange further comprises a plurality of equally spaced fastener apertures for attachment to said top surface of said any sheathing layer.

7. The system of claim 6, wherein said plurality of louvered ventilation slots in said wall portion further comprises outwardly angled penetrations arranged in a horizontal orientation parallel to one another.

8. The system of claim 7, wherein said first plurality of vented drip edges cover said first gap formed between a lower edge portion of said first sheathing layer and a lower edge portion of said second sheathing layer; and, wherein said second plurality of vented drip edges cover said second gap formed between a lower edge portion of said ridge sheathing layer and a lower edge portion of said second sheathing layer.

9. The system of claim 8, wherein said plurality of ventilation slots in said wall portion being spaced at intervals of approximately between one-eighth and one-quarter inches.

10. The system of claim 9, wherein said first gap and said second gap further comprise a width of approximately two inches.

11. The system of claim 10, wherein said first sheathing layer further comprises a first plurality of adjacently abutting planar panels each having a length, a width, and a thickness affixed atop a plurality of rafters of said roof structure for providing a first fastening base to said second sheathing layer;

wherein said second sheathing layer further comprises a second plurality of adjacently abutting planar panels having a length, a width, and a thickness for providing a second fastening base to a plurality of exterior roofing materials; and, wherein said ridge sheathing layer further comprises a plurality of an inverted V-shaped panels having a length, a width, a thickness, and an apex angle substantially equivalent to an angle of said ridge portion of said roof structure for providing a third fastening base to said plurality of exterior roofing materials.

12. The system of claim 11, wherein said first sheathing layer, said second sheathing layer further, and said ridge sheathing layer further comprises a preferred thickness of between one-half and three-quarter inches.

13. The system of claim 12, wherein said ridge sheathing layer further comprises a width approximately between six and twelve inches.

14. The system of claim 13, wherein said first plurality and said second plurality of vent channels being made from extruded or formed plated sheet metal or plastic.

15. The system of claim 14, wherein said first plurality and second plurality of vent channels further comprise a gauge thickness of between approximately sixteen and eighteen.

16. A ventilated roofing system for use with a roof structure, said system comprising:

a first sheathing layer comprising a first plurality of adjacently abutting planar panels each having a length, a width, and a thickness affixed atop a plurality of rafters of a roof structure extending from a ridge portion to an eave portion for providing a first fastening base to a second sheathing layer;

said second sheathing layer comprising a second plurality of adjacently abutting planar panels having a length, a width, and a thickness disposed above said first sheathing layer in a parallel orientation extending from said ridge portion to said eave portion for providing a second fastening base to a plurality of exterior roofing materials;

a ridge sheathing layer comprising a plurality of an inverted V-shaped panels having a length, a width, a thickness, and an apex angle substantially equivalent to an angle of said ridge portion of said roof structure disposed above said second sheathing layer in a parallel orientation and extending a length of said ridge portion of said roof structure for providing a third fastening base to said plurality of exterior roofing materials;

a first plurality of vented channels affixed between a top surface of said first sheathing layer and a bottom surface of said second sheathing layer forming a first gap;

a second plurality of vented channels affixed between a top surface of said second sheathing layer and a bottom surface of said ridge sheathing forming a second gap; and, a plurality of vented drip edges capable of attachment to lower edge portions of said second sheathing layer or said ridge sheathing layer for facilitating proper water drainage;

wherein said first plurality of vented channels and said second plurality of vented channels each comprise:

a planar top panel;

a pair of angled side panels extending downwardly from said top panel, each of said side panels having a plurality of rectangular vent openings; and, a horizontal fastening flange extending longitudinally along a bottom edge portion of each of said pair of side panels, said fastening flange further comprising a plurality of equally spaced fastener apertures capable of attachment to said top surface of said first sheathing layer or a top surface of said second sheathing layer;

wherein said plurality of vented drip edges each comprise:

a substantially planar top portion capable of laying flat against a top surface of a lower edge portion of said second sheathing layer or a top surface of a lower edge portion of said ridge sheathing layer;

a substantially planar wall portion extending downwardly from said top portion, said wall portion having a plurality of louvered ventilation slots; and, an outwardly deflected drip edge longitudinally extending along a bottom edge portion of said wall portion;

wherein a first plurality of vented drip edges cover said first gap formed between a lower edge portion of said first sheathing layer and a lower edge portion of said second sheathing layer;

wherein a second plurality of vented drip edges cover said second gap formed between a lower edge portion of said ridge sheathing layer and a lower edge portion of said second sheathing layer; and, wherein said system provides a flow of air between said eave portion and said ridge portion of said roof structure.

17. The system of claim 16, wherein said first plurality of vented channels being arranged in a matrix configuration comprising a plurality of right angles; and, wherein said second plurality of vented channels being parallel to said ridge of said roof structure.

18. The system of claim 17, wherein said plurality of ventilation slots in said wall portion being spaced at intervals of approximately between one-eighth and one-quarter inches; and, wherein said first gap and said second gap further comprise a width of approximately two inches.

* * * * *